US006802904B2

(12) United States Patent
Pedigrew

(10) Patent No.: US 6,802,904 B2
(45) Date of Patent: Oct. 12, 2004

(54) DEVICE FOR TWO-DIMENSIONAL APPLICATION OF FREE-FLOWING ADHESIVE TO STRIP MATERIAL

(75) Inventor: Colin Pedigrew, Erkrath (DE)

(73) Assignee: Nordson Corporation, Westlake, OH (US)

( * ) Notice: Subject to any disclaimer, the term of this patent is extended or adjusted under 35 U.S.C. 154(b) by 127 days.

(21) Appl. No.: 09/972,089

(22) Filed: Oct. 5, 2001

(65) Prior Publication Data

US 2002/0152957 A1 Oct. 24, 2002

(30) Foreign Application Priority Data

Oct. 16, 2000 (DE) ..... 100 51 201

(51) Int. Cl.[7] ..... B05C 3/02
(52) U.S. Cl. ..... 118/410; 118/419
(58) Field of Search ..... 118/410, 419, 118/325, 500; 156/578

(56) References Cited

U.S. PATENT DOCUMENTS 3,645,233 A * 2/1972 Mishler
3,665,890 A * 5/1972 Mishler
3,905,858 A * 9/1975 Townsend et al.
6,001,179 A 12/1999 Ueberschär et al. ..... 118/410
6,174,567 B1 1/2001 Ueberschär et al. ..... 427/356
6,520,237 B1 * 2/2003 Bolyard, Jr. et al.
6,582,518 B2 * 6/2003 Riney

* cited by examiner

*Primary Examiner*—Brenda A. Lamb
(74) *Attorney, Agent, or Firm*—Wood, Herron & Evans, L.L.P.

(57) ABSTRACT

A device for the two-dimensional application of free-flowing adhesive to strip material, especially to furniture edge banding. An adhesive channel is contained in an applicator head and an applicator valve selectively blocks or releases the flow of adhesive in the adhesive channel. A slot nozzle communicates with the adhesive channel, which nozzle has a slot-shaped exit opening for dispensing adhesive onto the strip material. A guide device for guiding the strip material past the exit opening of the slot nozzle along a defined path is removably attached to the applicator head. The guide device includes a first guide element which comes in contact during operation with the surface of the strip material opposite the surface to be glued, and at least one additional guide element which comes in contact during operation with an edge of the strip material.

10 Claims, 6 Drawing Sheets

DEVICE FOR TWO-DIMENSIONAL APPLICATION OF FREE-FLOWING ADHESIVE TO STRIP MATERIAL

This application claims the priority of German Patent Application No. 10051201.1 filed Oct. 16, 2000, the disclosure of which is hereby fully incorporated by reference herein.

FIELD OF THE INVENTION

The present invention pertains to a device for the two-dimensional application of free-flowing adhesive to a strip material, especially furniture edge banding, which is in motion relative to the device.

BACKGROUND OF THE INVENTION

Devices of this type are used to apply adhesives two-dimensionally to furniture parts or strip-like substrates. The applicator head is usually mounted on a frame, and the strip material is conveyed past the applicator head by a transport device. During operation, the adhesive emerges from the elongated exit opening of the slot of the slot nozzle assembly and is dispensed onto the surface of the substrate being conveyed past the exit opening. The elongated exit opening of the slot is usually oriented crosswise or transverse to the direction of the relative motion between the applicator head and the substrate.

When so-called edge banding is glued to the edges of furniture, the procedure used so far according to the state of the art is to apply glue to the edge of a furniture part and then to press the edge banding, which is a flexible material strip of plastic, onto the previously glued edge of the furniture part. The glue is applied to the furniture part either by hand with considerable effort or with the help of automatic devices, which apply the adhesive by machine to the furniture parts. In both cases, considerable expense is involved.

SUMMARY OF THE INVENTION

The task of the present invention is to provide an application device and a guide device suitable for applying an adhesive directly to strip material or the like. In particular, an application device of this invention easily and precisely applies edge banding, molding, or the like keep parts or other workpieces.

According to the invention, a guide device guides the strip material past the exit opening of a slot nozzle along a defined path. The guide device includes a first guide element, which comes in contact during operation with the surface of the strip material opposite the surface to be glued, and at least one additional guide element, which comes in contact during operation with an edge of the strip material. The guide device is preferably attached in a removable manner to an applicator head having the slot nozzle.

With a simple design, the invention makes it possible to apply adhesive precisely and reliably in two dimensions to strip material, edge banding for furniture parts, molding strips, etc. The guide device according to the invention has a first guide element which ensures that the strip material to be glued is conducted past the exit opening of the slot nozzle either at an adjustable distance or in actual contact with the slot nozzle, so that the free-flowing adhesive is applied reliably and uniformly to the surface of the strip material to be glued. According to the invention, furthermore, the gluing as such and its quality can be influenced by adjusting the distance between the guide element and the exit opening, as a result of which the thickness of the applied glue can be controlled. Using at least one additional guide element, the strip material to be glued is also guided laterally along the desired path, to achieve the optimum orientation of the strip material to be glued relative to the exit opening of the slot nozzle. Through the attachment of the guide device directly to the applicator head, complicated support structures can be eliminated, and the guide device can be easily retrofitted to existing applicator heads. If an applicator head is also used for a different purpose which does not require the guidance of a strip-like substrate, the guide device can be easily removed from the applicator head. After the application of the adhesive to the strip material, the material can be bonded to other workpieces; for example, edge banding can be glued to furniture parts.

In a preferred embodiment of the invention, it is proposed that the guide device is supported by a swivel joint on the applicator head. As a result of this swiveling support, the guide device can move easily by virtue of its design so that, first, it can be adjusted to accommodate strip material of different thicknesses and, second, so that the first guide element can be moved between a contact position, in which the strip material to be glued is pressed against the nozzle assembly to create contact with the surface to be glued, and a rest position. In this latter position, production may be interrupted or gluing may be stopped, and the guide element makes no contact with either the slot nozzle or with the strip material.

According to a further aspect of this embodiment, the guide device maybe swiveled by a pneumatic cylinder. The first guide element is mounted at such as a distance from the swivel joint that, when the guide device is swiveled, the distance between the first guide element and the exit opening of the slot nozzle changes. In this way, the movement between the working position and the rest position can be easily produced.

Another embodiment is characterized by a preloading device to exert a preloading force on the guide device and/or the guide element toward a rest position, in which the guide element is held a certain distance away from the slot nozzle. The preloading device is preferably designed as a spring. As a result, in the case of an unwanted interruption in the operation (e.g. emergency shutdown), the strip material to be glued will not be pressed against the slot nozzle, which may be heated. Instead, the guide element will be swiveled into a rest position a certain distance away from the exit opening of the slot nozzle.

In a variant of the guide device according to the invention, it is provided that the first guide element is designed as a cylindrical bolt, which is set up essentially parallel to the exit opening. Such cylindrical bolts are easy to manufacture and provide reliable guidance with little friction. As alternatives, the first guide element could also be designed as a plate or as a rotating roll.

In another embodiment, it is proposed that two additional edge-guide elements be attachable to a support at variable distances from each other. These two edge-guide elements guide the substrate on both sides so that no unwanted shifting relative to the elongated exit opening of the slot can occur. Because the distances between the two elements is variable, it is also possible to adapt the guide to strip material or substrates of different widths.

It is also preferred that the support be mounted so that its position, along with that of the edge-guide elements, can be adjusted and then fixed in place on the guide device. This allows the two edge-guide elements to be aligned jointly relative to the strip material.

In another embodiment, the guide device is provided with a guide slot formed by plates a certain distance apart. The substrate or strip material is conveyed through this guide slot. With the help of this guide slot, it is possible to process, in particular, strip materials which have already been cut into sections. Such sections of material are fed reliably through the guide slot to the slot nozzle, even if the material is flexible or has the tendency to bunch up, as can be the case with edge banding.

BRIEF DESCRIPTION OF THE DRAWINGS

Various additional features, objects and advantages will be readily recognized upon further review of the exemplary embodiments. The invention is described below on the basis of the exemplary embodiments with reference to the attached drawings.

DETAILED DESCRIPTION OF THE PREFERRED EMBODIMENTS

Figure 1:
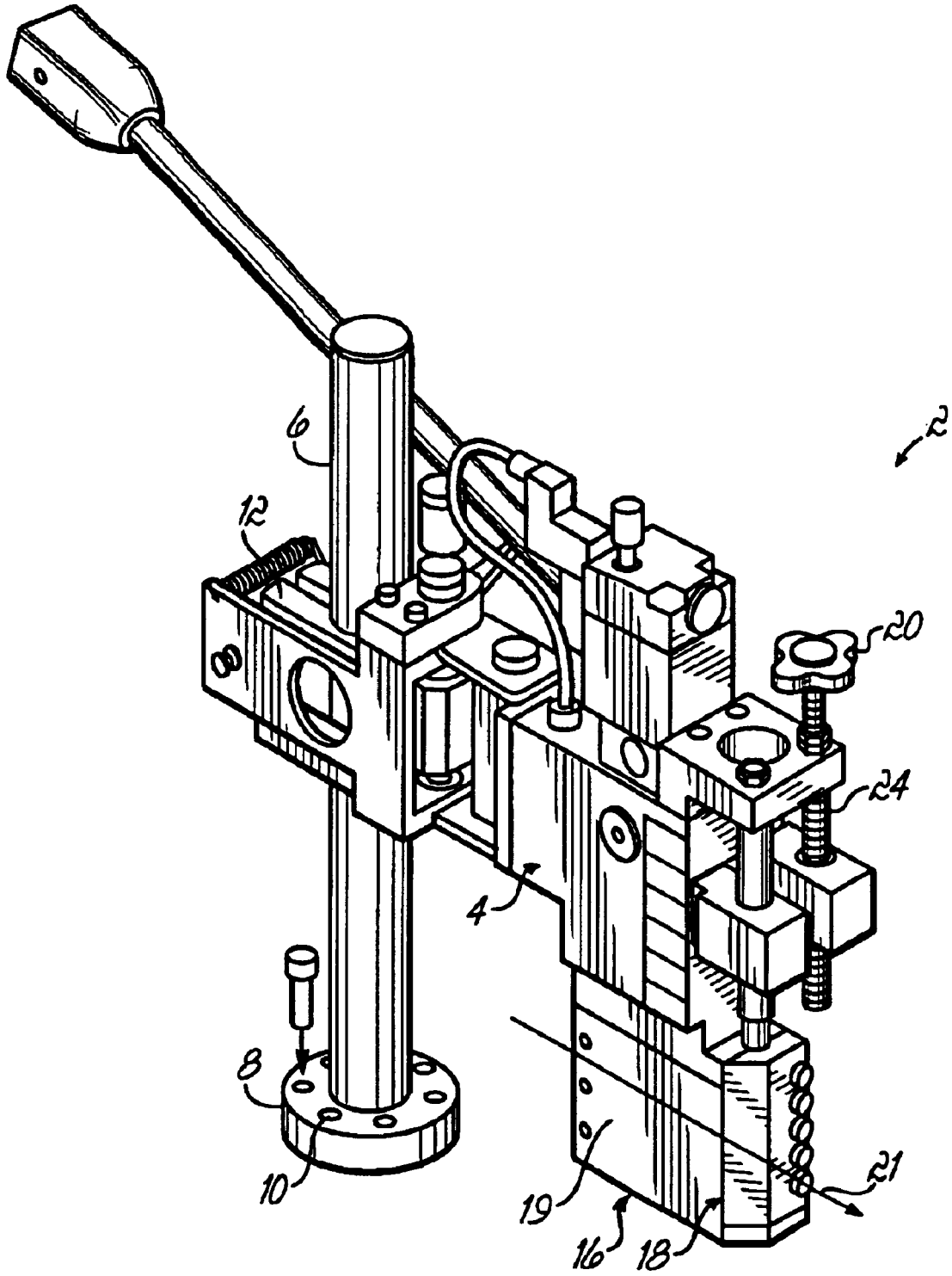
FIG. 1 is a perspective view of a device according to the invention for applying adhesive.

The applicator device 2 and guide device 3 shown in the drawings serve to apply adhesive to strip material, which can move relative to the applicator device 2. Devices 2, 3 are used especially for the gluing of so-called edge banding for furniture (furniture edge banding) which consists, for example, of flat, flexible plastic material, and is glued to the external surfaces of furniture or parts of furniture. Of course, other substrates such as molding, packaging material, etc., could also be coated with adhesive in two dimensions with the same devices.

As FIGS. 1 to 4 show with particular clarity, an applicator head 2 has a base body 4 with an adhesive channel (not shown) in this base body 4. A support post 6 is used to support and position the applicator head 2 permanently in a defined position. The support post 6 is provided at the bottom end with an attachment flange 8, through which holes 10 pass, so that the post 6 can be screwed to a stationary structure (not shown). The applicator head 2 can be fastened to the support post 6 in any desired position by a clamping device 12. For this purpose, a locking screw is tightened manually by a handle 14 so that a friction-locking connection is established between the locking device 12 and the support post 6, which connection can also be released again to allow adjustment.

On a section of the applicator head 2 (at the bottom in FIG. 1), there is a nozzle assembly, which is designed as a slot nozzle 16, and is screwed to the base body 4, so that adhesive can flow through the adhesive channel into the slot nozzle 16 and then be discharged through a slot with an elongated, slot-like exit opening 18. During operation, the strip material to be glued slides along a slide plate 19 in the direction of the arrow 21 (FIG. 1), which illustrates the direction of relative motion.

In the applicator head 2, there is an applicator valve (not shown) for the selective blocking or release of the flow of adhesive through the adhesive channel and thus through the exit opening 18. The applicator valve can be actuated pneumatically. For example, a needle valve can be used, in which a needle cooperates with a valve seat.

A sealing body (not shown) is mounted with freedom of movement in the slot of the slot nozzle 16 and seals off the slot laterally. The sealing body is rigidly connected to a cylindrical piston, which moves axially inside one of the distribution channels. The sealing body extends from the piston to the exit opening 18 of the slot nozzle 16. By shifting the sealing body in the slot together with the piston in the distribution channel, the length of the slot and thus the length of the exit opening 18 can be varied.

By rotating a handwheel 20, which is connected to a threaded rod 24, the width of the slot and thus the width of the exit opening 18 can be varied in the manner described above. By positioning the entire applicator head 2 and thus the slot nozzle 16, it is possible to arrive at the exact position of the slot and of the exit opening 18 desired.

Figure 2:
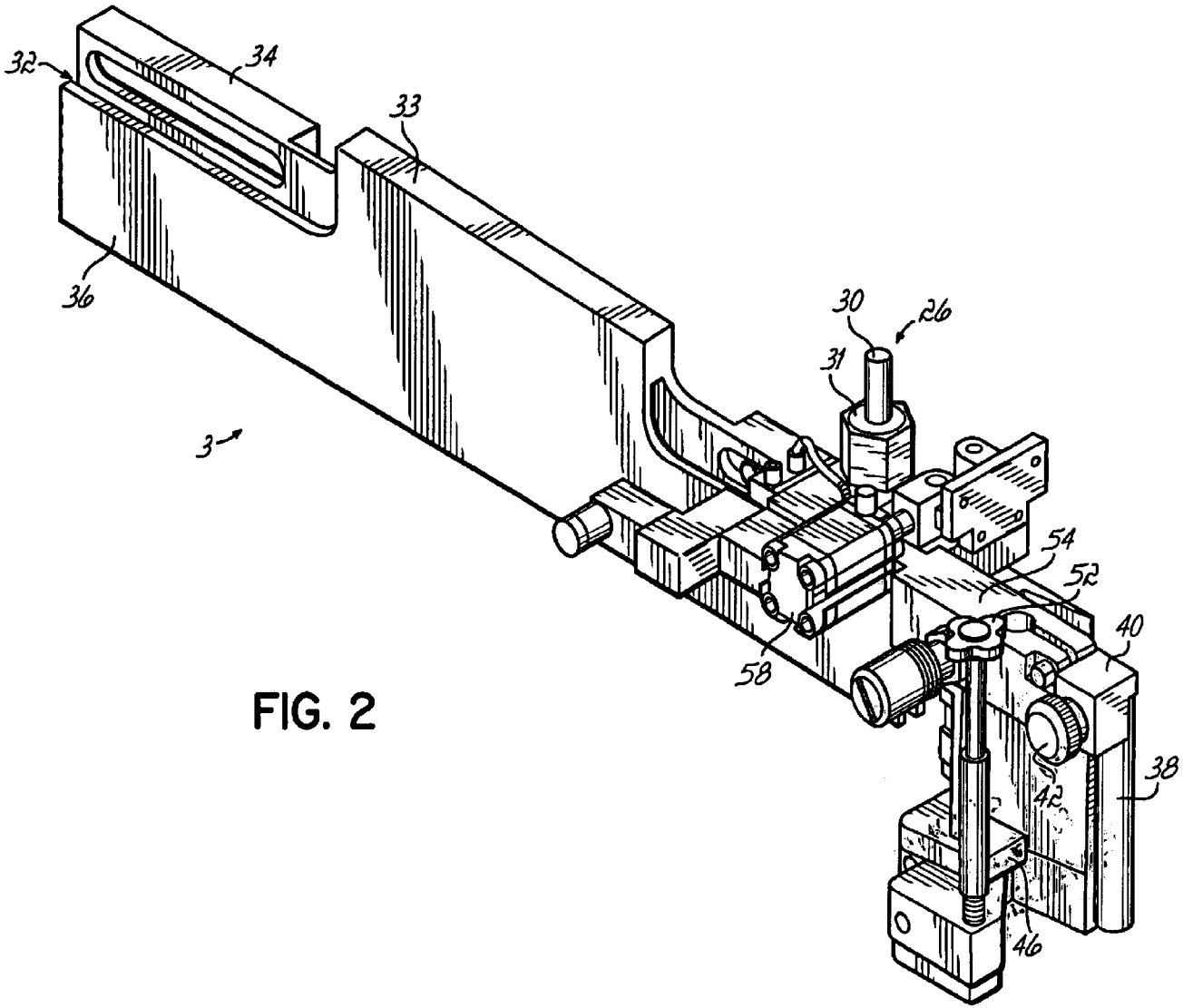
FIG. 2 is a perspective view of a guide device according to the invention.
Figure 3:
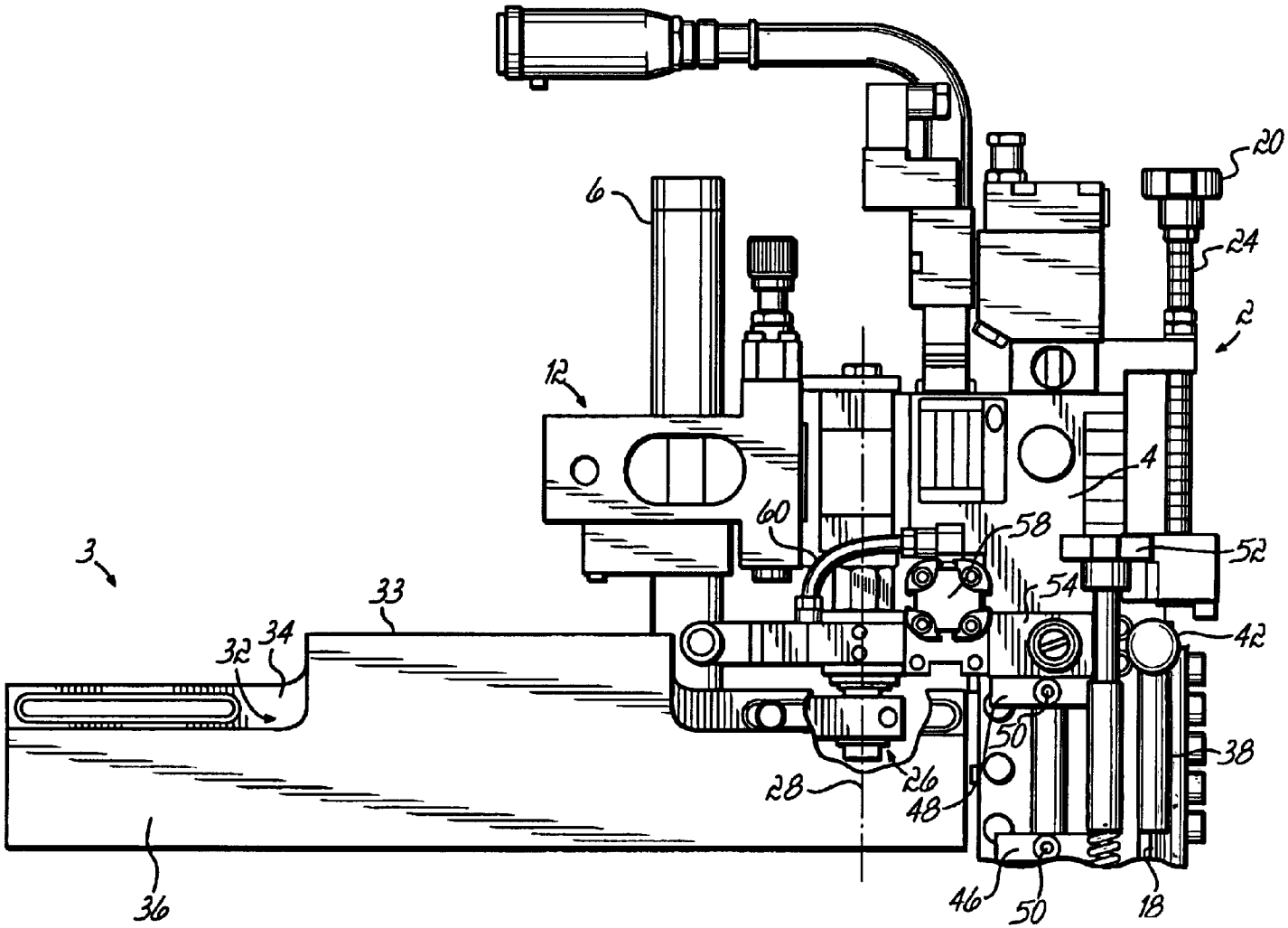
FIG. 3 is a side view of the applicator device according to FIG. 1 with a mounted guide device according to FIG. 2.
Figure 4:
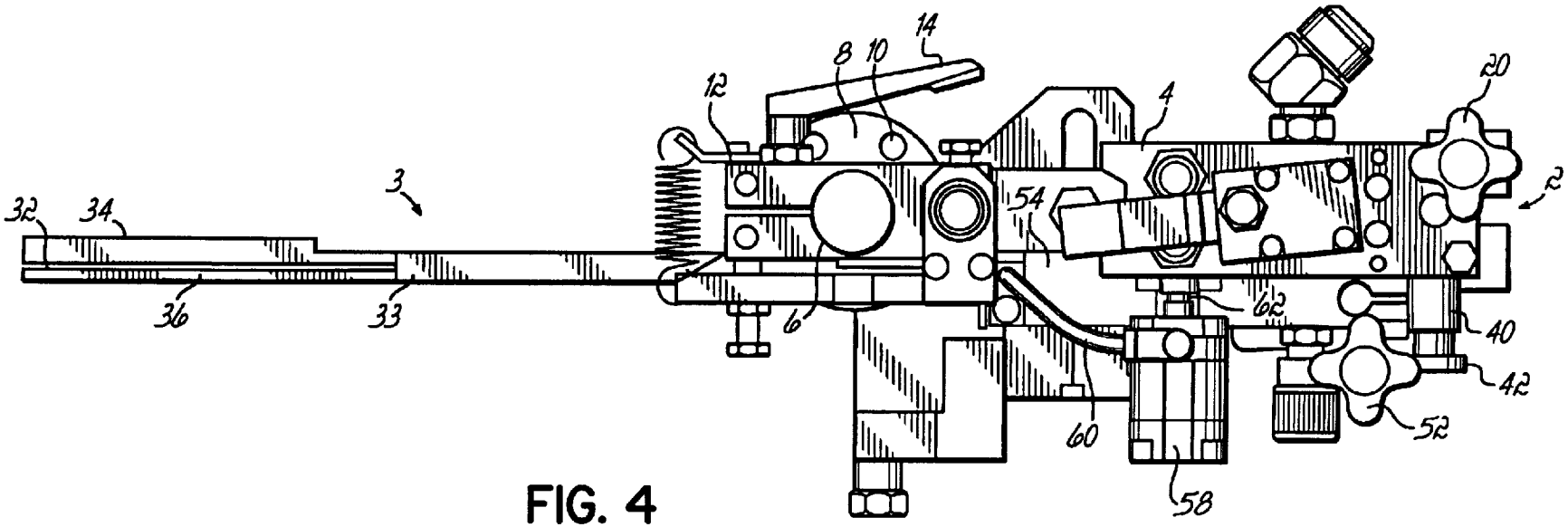
FIG. 4 is a plan view of the device according to FIG. 3.
Figure 5:
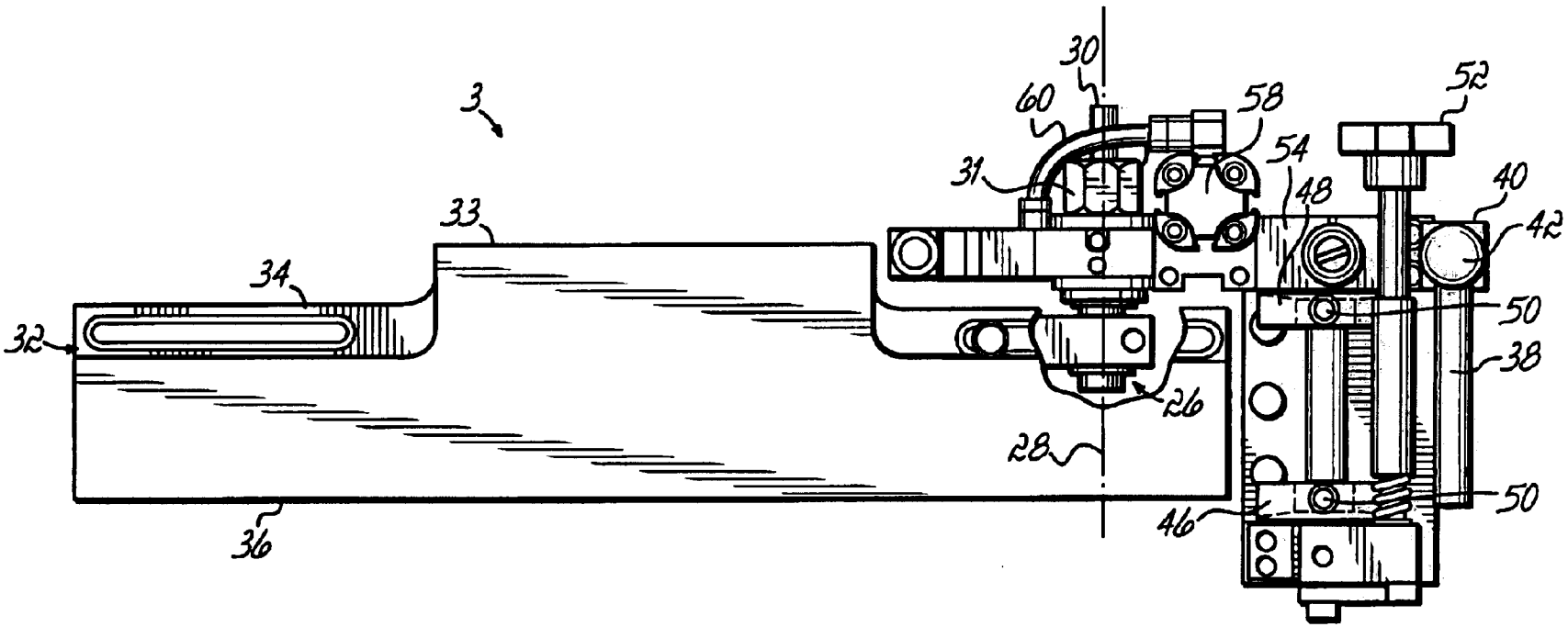
FIG. 5 is a side view of the guide device according to FIG. 2.
Figure 6:
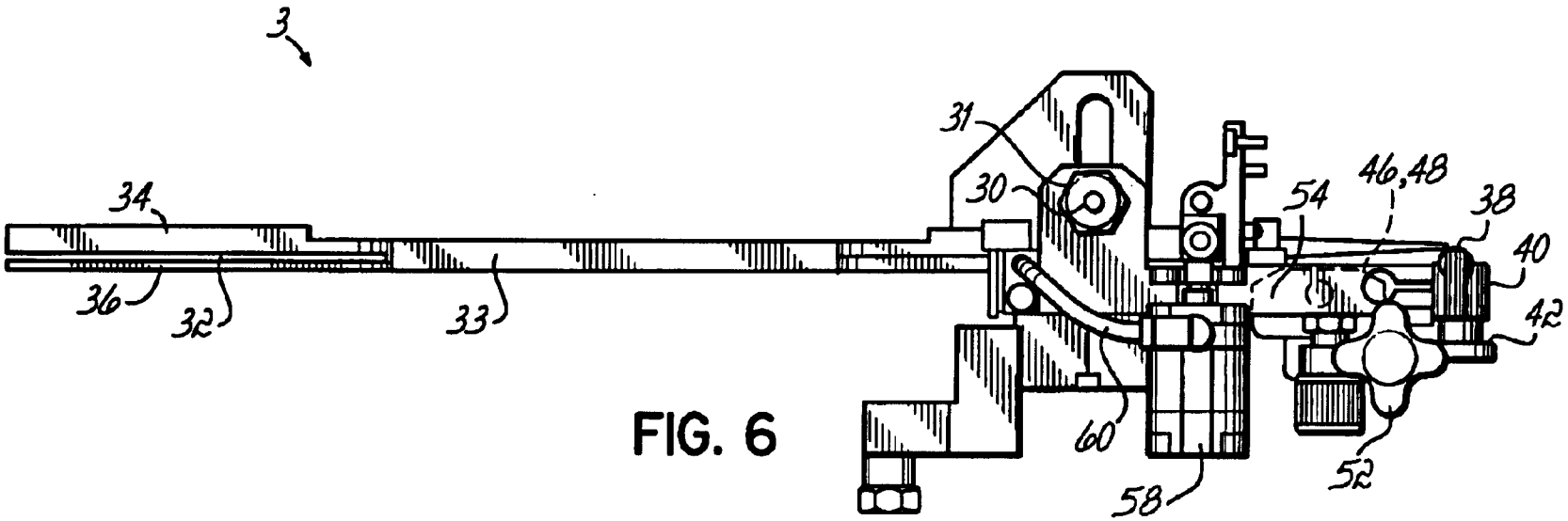
FIG. 6 is a plan view of the guide device according to FIG. 2.

The guide device 3, illustrated seperately in FIGS. 2, 5, and 6, is mounted directly on the applicator head 2, or, more precisely, on the base body 4 of the applicator head, by a swivel joint 26, so that the guide device 3 can be swiveled around a rotational axis 28 relative to the applicator head 2. The swivel joint 26 has a bolt 30, which is mounted in a hole in the base body 4 as well as a lock nut 31.

The guide device 3 serves to conduct the strip material past the exit opening 18 of the slot nozzle 16 in a defined manner. The strip material is first introduced through a slot 32, which is formed between two plates 34, 36 a certain distance apart. Plates 34, 36 are connected to each other by a connecting web 33. The strip material is conducted and guided through the slot 32 by a suitable conveying device (not shown). Alternatively, it would also be possible to provide only a single plate as a guide for the strip material in the feed area.

The guide device 3 has a first guide element 38, which is designed as a rigid cylindrical bolt with a polished surface and which is essentially parallel to the exit opening 18. During operation, the first guide element 38 is in its working position at a defined, adjustable distance from the exit opening of the slot nozzle (compare FIG. 3) and in contact with a surface of the strip material, which is opposite the surface of the strip material to be glued. The guide element 38 fits into a holding fixture 40 and can be removed or replaced by loosening the screw 42, so that it can easily be cleaned.

Two additional edge-guide elements 46, 48, attached to a support 44 (see FIG. 3) ensure during operation that the strip material is guided laterally, i.e., at the top and bottom in the example shown here, With these additional edge-guide elements 46, 48 contacting opposite edges or borders of the strip material. The support 44 is designed in the form of a rod. Using screws 50, the distance of the guide elements 46, 48 from each other can be adjusted; that is, after screws 50 have been loosened, the edge-guide elements 46, 48 can be slid along the support 44 until in the desired position, whereupon the screws 50 are tightened again. It is therefore possible to adapt the device to strip materials of different widths with a mechanism of very simple design. As a result of the guidance provided by the guide element 38 and additionally by the edge-guide elements 46, 48, the strip material to be glued is guided reliably so that the glue can be applied uniformly in two dimensions.

The support 44 can also be moved in the vertical direction to arrive at a so-called production zero point by the use of an adjusting screw 52.

The guide device can be swiveled by means of a pneumatic cylinder 58 around the rotational axis 28 of the swivel joint 26. A swivel support 54 holds the holding fixture 40 and thus the first guide element 38 as well as the additional edge-guide elements 46, 48 and their support 44. The pneumatic cylinder 58 can be actuated with pressurized gas supplied through a compressed air line 60 in such a way that the support 54 is swiveled by a piston rod 62 away from the applicator head 2 and the base body 4 and thus into the desired working position, so that the guide element 38 is situated at the desired distance from the exit opening 18.

When the compressed air is turned off, the support 54 swings back into a rest position as a result of the force of the spring integrated into the pneumatic cylinder 58, in which rest position the guide element 38 is farther away from the exit opening 18 and the strip material is no longer being conducted past the exit opening to receive a coating of glue. The spring is thus a preloading device for exerting a preloading force on the swiveling guide device 3 and on the guide element 38 toward a rest position, in which the guide element 3 is held a certain distance away from the slot nozzle 16.

While the present invention has been illustrated by a description of preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations defending on the needs and preferences of the user. This has been a description of the present invention, along with the preferred methods of practicing the present invention as currently known. However, the invention itself should only be defined by the amended claims, wherein I claim:

What is claimed is:

1. A dispensing device for applying adhesive onto a moving substrate having opposite first and second outer surfaces and an edge, comprising:

an applicator head having a slot no opening and operative to selectively block and release flow of the adhesive from said slot opening of said slot nozzle onto the first outer surface of the moving substrate; and a guide device attached to said applicator head, said guide device including a first guide element configured to contact the second outer surface of the moving substrate, and a second guide element adapted to contact the edge of the moving substrate.

2. The dispensing device of claim 1, further comprising a swivel joint attaching said guide device to said applicator head.

3. The dispensing device of claim 2, further comprising:

a pneumatic cylinder operatively coupled to said guide device to move said guide device about said swivel joint, said first guide element being mounted in a distanced manner from said swivel joint such that, when said guide device swivels, the distance between said first guide element and said slot opening changes.

4. The dispensing device of claim 1, further comprising:

a preloading device operative to exert a preloading force on said guide device toward a rest position in which said first guide element is distanced from said slot nozzle.

5. The dispensing device of claim 4, wherein said preloading device comprises a spring.

6. The dispensing device of claim 1, wherein said first guide element comprises a cylindrical bolt and is essentially parallel to said slot opening.

7. The dispensing device of claim 1, further comprising a third guide element and a support, said second and third guide elements being fixed to said support at a variable distance from each other.

8. The dispensing device of claim 7, wherein said support is supported on said guide device so that said support can be adjusted and held in a desired position.

9. The dispensing device of claim 1, wherein said guide device includes a guide slot formed by two spaced apart plates for receiving the moving substrate.

10. The dispensing device of claim 1, wherein said guide device is removably attached to said applicator head.

* * * * *

UNITED STATES PATENT AND TRADEMARK OFFICE

CERTIFICATE OF CORRECTION

PATENT NO. : 6,802,904 B2
DATED : October 12, 2004
INVENTOR(S) : Colin Pedigrew

It is certified that error appears in the above-identified patent and that said Letters Patent is hereby corrected as shown below:

Column 1,
Line 45, delete “keep” and insert -- to furniture --.

Column 5,
Line 30, change “defending” to -- depending --
Line 35, change “amended” to -- appended --
Line 40, change “no opening” to -- nozzle with a slot opening --.

Signed and Sealed this

Nineteenth Day of April, 2005

JON W. DUDAS
*Director of the United States Patent and Trademark Office*